US007731415B2

(12) United States Patent
Conus et al.

(10) Patent No.: US 7,731,415 B2
(45) Date of Patent: Jun. 8, 2010

(54) HIGH-PERFORMANCE LEVER ESCAPEMENT

(75) Inventors: Thierry Conus, Lengnau (CH); Andrés Cabezas Jurin, Yverdon-les-Bains (CH); Kaspar Truempy, Soleure (CH)

(73) Assignee: Montres Breguet SA, L'Abbaye (CH)

( * ) Notice: Subject to any disclaimer, the term of this patent is extended or adjusted under 35 U.S.C. 154(b) by 0 days.

(21) Appl. No.: 11/994,714

(22) PCT Filed: Jun. 28, 2006

(86) PCT No.: PCT/EP2006/063616

§ 371 (c)(1),
(2), (4) Date: Jul. 1, 2008

(87) PCT Pub. No.: WO2007/003539

PCT Pub. Date: Jan. 11, 2007

(65) Prior Publication Data

US 2008/0298179 A1 Dec. 4, 2008

(30) Foreign Application Priority Data

Jul. 4, 2005 (CH) ..... 1120/05

(51) Int. Cl.
*G04B 15/00* (2006.01)
*G04B 17/00* (2006.01)

(52) U.S. Cl. ..... 368/131; 368/169

(58) Field of Classification Search ..... 368/124, 368/125, 127–131, 168–169; 74/1.5
See application file for complete search history.

(56) References Cited

U.S. PATENT DOCUMENTS 22,791 A * 2/1859 Fasoldt ..... 368/133
46,652 A * 3/1865 Fasoldt ..... 368/131

(Continued)

FOREIGN PATENT DOCUMENTS

CH 358036 12/1961

(Continued)

OTHER PUBLICATIONS

International Search Report issued in corresponding application No. PCT/EP2006/063616, completed Mar. 14, 2007 and mailed Mar. 22, 2007.

(Continued)

*Primary Examiner*—Vit W Miska
(74) *Attorney, Agent, or Firm*—Griffin & Szipl, P.C.

(57) ABSTRACT

The invention concerns an escapement (1) for a timepiece comprising an anchor (2) articulated on a stem (3) and co-operating with an escapement mobile (4) articulated on an axis (5), said mobile comprising a plurality of teeth (8; 15, 16) uniformly spaced around said mobile, said anchor including an entry pallet (6) and an exit pallet (7) arranged to receive alternately an impulse from one of the teeth borne by the mobile and for acting as rest plane for said tooth. The invention is characterized in that the escapement mobile (4) comprises first and second integral and coaxial wheels (13, 14) including each the same number of teeth (15, 16), in that the entry and exit pallets (6, 7) co-operate respectively with the first and second wheels (13, 14) and in that the peripheral radius (R1) of the first wheel (13) is greater than the peripheral radius (R2) of the second wheel (14).

5 Claims, 3 Drawing Sheets

U.S. PATENT DOCUMENTS

| | | | | |
|---|---|---|---|---|
| 6,301,981 | B1 * | 10/2001 | Oechslin | 74/1.5 |
| 6,708,576 | B2 * | 3/2004 | Oechslin | 74/1.5 |
| 6,802,645 | B2 * | 10/2004 | Ludwig | 368/127 |
| 7,366,058 | B2 * | 4/2008 | Marki et al. | 368/220 |

FOREIGN PATENT DOCUMENTS

| | | |
|---|---|---|
| CH | 570 644 | 12/1975 |
| CH | 609824 | 3/1979 |
| DE | 1 163 253 | 5/1959 |
| DE | 25 20 758 | 11/1976 |
| EP | 0 018 796 | 11/1980 |
| EP | 1 517 197 A1 | 3/2005 |
| FR | 841 089 | 5/1939 |

OTHER PUBLICATIONS

Clement Saucy et al., "Micro Fabrication par électroformage: avantages, limitations et perspectives," Journeé D' Étude 2003, pp. 9-11.

G.-A. Berner, Illustrated Professional Dictionary of Horology I+II, pp. 973-975.

Theory of Horology Handbook, p. 102.

* cited by examiner

HIGH-PERFORMANCE LEVER ESCAPEMENT

This is a National Phase Application in the United States of International Patent Application PCT/EP 2006/063616 field Jun. 28, 2006, which claims priority on Swiss Patent Application No. 01120/05, filed Jul. 4, 2005. The entire disclosures of the above patent applications are hereby incorporated by reference.

FIELD OF THE INVENTION

The present invention concerns a high-output escapement for a timepiece including a pallet articulated on a staff and cooperating with an escapement wheel set articulated on an arbour, this wheel set comprising a plurality of teeth spaced apart in a regular manner around said wheel set, this pallet comprising an entry pallet-stone and an exit pallet-stone arranged to receive alternatively an impulse coming from one of the teeth carried by the wheel set and to be used subsequently as a locking plane for said tooth.

BACKGROUND OF THE INVENTION

An escapement answering the definition exposed in the paragraph above is known under the denomination of Swiss escapement lever where each of the pallet-stones receives alternatively an impulse to launch a balance with which said escapement is fitted, the escapement wheel set and the pallet being maintained at rest while this balance achieves its so-called supplementary arc freely. The Swiss lever escapement is the escapement most commonly used in the watch industry. In the majority of the cases its pallet is equipped with pallet-stones substantially arranged at equal distance from a line connecting the axis of the escapement wheel set to the staff on which the pallet is articulated, this wheel set comprising a single escapement wheel.

A Swiss lever escapement answering the definition exposed in the first paragraph of this description is described in the patent document CH-570 644. This document proposes an escapement with high output. It recalls that the escapement in a watch is used to transmit the energy of the driving spring to the balance which acts as the regulator of the running of the watch. However the running precision, and in particular the sensitivity of the running of a watch to disturbances, is closely related to the energy which can be accumulated in the sprung-balance system. This energy depends on several factors, as inter alia, the output of the gear train and the output of the escapement. The total output of the escapement can be divided into an escapement wheel-pallet output and a pallet-balance output.

In modern watches, the output of the gear train and the pallet balance output is more or less optimized. That is however not the case of the escapement wheel-pallet output and working on its improvement corresponds to an increase of the quality of the running of the watch.

According to the cited document, the improvement of the escapement wheel-pallet output can be done by increasing the energy which is provided to the balance at the time of the impulse given to the pallet-stones of the pallet by the teeth of the escapement wheel. The same document shows that this increase in energy is quite real if the pallet-stone describes a trajectory which makes, at the point of contact with the tooth of the escapement wheel, an angle as small as possible with the trajectory of said tooth. This can be obtained while moving away the entry pallet-stone and by bringing closer the exit pallet-stone, which causes a maximum bringing together of the directions of displacement of said pallet-stones and the direction of the displacement of the teeth of the escapement wheel.

FIG. 1 shows by way of example an escapement drawn according to principles of the prior art where the theoretical instantaneous outputs are clearly improved compared to a conventional escapement. One recognizes in particular the driving wheel set 4 in the shape of a single escapement wheel and the receiving wheel set 9 in the shape of a pallet, both turning around their respective arbour and staff 5 and 3. The escapement wheel 4 carries teeth 8 which transmit driving energy to the entry and exit pallet-stones 6 and 7 of pallet 2, which, via its fork 9, transmits it to the balance, respectively to impulse-pin 10 of roller 11 of the balance. According to the prior invention, the entry 6 and exit 7 pallet-stones embrace a number of teeth 8 at least equal to the fifth of the total number of teeth carried by the escapement wheel 4. Moreover, the entry pallet-stone 6 embraces, starting from a line 12 connecting arbour 5 of wheel 4, at least one tooth 8 more than the exit pallet-stone 7 embraces, starting from said line.

SUMMARY OF THE INVENTION

The applicant of this invention realized that the high output brought by the invention of the prior art could still be increased and that even if the pallet stones of the pallet are arranged substantially at equal distance of the line connecting the arbour of the escapement wheel set to the staff on which the pallet is articulated. In order to achieve this result, the present invention, in addition to the fact that it obeys the first paragraph of this description, is characterised in that the escapement wheel set comprises first and second integral and coaxial wheels including the same number of teeth, in that the entry and exit pallet-stones cooperate respectively with the first and second wheels and in that the peripheral radius of the first wheel is larger than the peripheral radius of the second wheel.

BRIEF DESCRIPTION OF THE DRAWINGS

The invention will now be explained in detail below in connection with a preferred embodiment given by way of example, this embodiment being illustrated by the annexed drawings in which.

DETAILED DESCRIPTION OF THE ILLUSTRATIVE EMBODIMENTS

Figure 1:
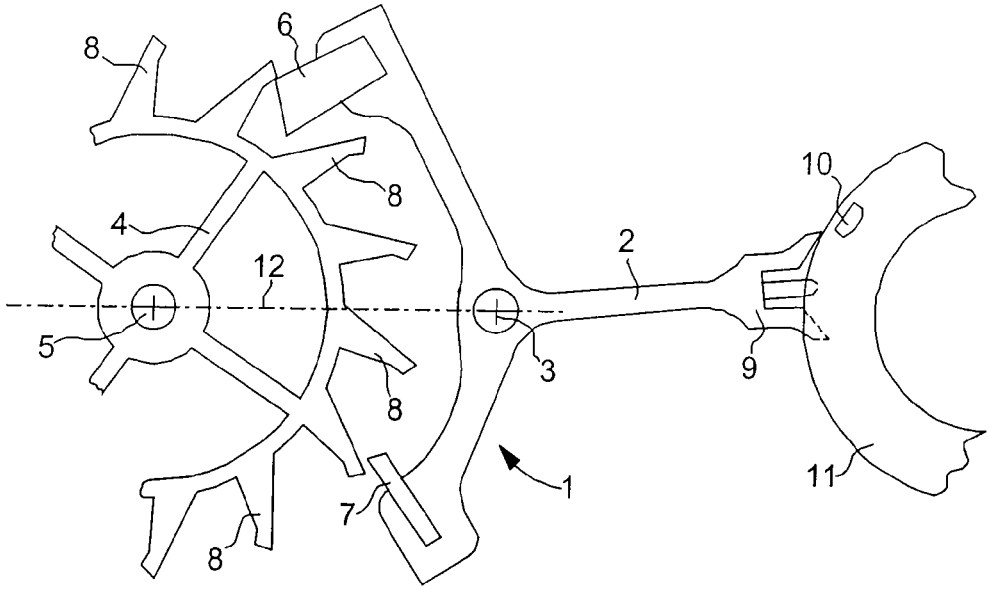
Fig. 1 ( Prior Art)
FIG. 1 is an illustration of the prior art.
Figure 2:
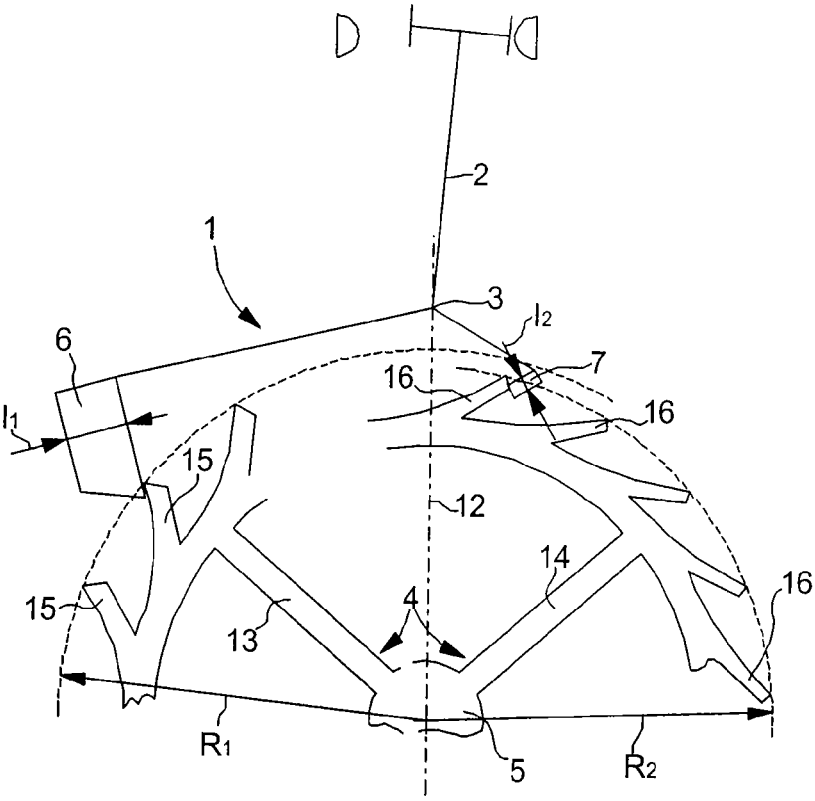
FIG. 2 is a stylised and schematic plan view of the escapement according to a preferred embodiment of this invention.

A preferred embodiment of the escapement according to the present invention is shown in FIG. 2. This escapement 1 is a stylized and diagrammatic plan view. It includes a pallet 2 articulated on a staff 3. The pallet cooperates with an escapement wheel set 4 articulated on an arbour 5. According to a characteristic of the invention, the escapement wheel set 4 comprises first and second wheels 13 and 14 integral and coaxial and each including a same number of teeth respectively designated 15 and 16. Pallet 2 carries an entry pallet-stone 6 co-operating with teeth 15 of first wheel 13 and one exit pallet-stone 7 co-operating with teeth 16 of second wheel 14. According to another characteristic of the invention the peripheral radius R1 of first wheel 13 is larger than the peripheral radius R2 of second wheel 14.

For more clarity, FIG. 2 shows, on the left, a part of the wheel 13 whose teeth 15 cooperate with the entry pallet-stone 6 and, on the right, a part of the wheel 14 whose teeth 16 cooperate with the exit pallet-stone 7. These two wheels are of course superimposed as well as their respective teeth 15 and 16, these teeth forming pairs comparable to teeth 8 of the single wheel set 4 of the prior art. Thus, as in the prior art and according to a preferred embodiment of this invention, for at least an angular position of the escapement wheel set 4, pallet-stones 6 and 7 embrace a number of pairs of teeth 15 and 16 at least equal to a fifth of the total number of pairs of teeth carried by wheel set 4 composed of the two wheels 13 and 14. In the same way, the entry pallet-stone embraces, starting from a line 12 connecting arbour 5 of wheel set 4 to staff 3 of pallet 2, at least one more pair of teeth 15 and 16 of said wheel set than the exit pallet-stone 7 embraces, starting from the aforementioned line. In the configuration shown in FIG. 2, the escapement wheel set 4 comprising wheels 13 and 14, includes 20 pairs of teeth 15 and 16 and the number of pairs of teeth 15 and 16 embraced by pallet-stones 6 and 7 is four, which corresponds effectively to the fifth of the total number of pairs of teeth. In the same manner the example illustrated in FIG. 2 shows three pairs of teeth 15 and 16 on the left of line 12 and only one pair of teeth on the right of this line, so that the entry pallet-stone 6 embraces, starting from line 12, at least one pair of teeth more than the exit pallet-stone 7 embraces, starting from this line.

As mentioned in the prior art, in order to improve the angles of transmission of the force, it is necessary to move away the entry pallet-stone 6 and to bring the exit pallet-stone 7 closer, the angle traveled by pallet 2 is larger at the entry than at the exit and, to obtain the favourable inclined planes, one is brought to make the escapement wheel set travel unequal paths during the functions: larger at the entry, smaller at the exit and to use an entry pallet-stone 6 broader than the exit pallet-stone 7 ($I1>I2$).

Replacing the single wheel of the prior art by two wheels, of which one has a larger radius and cooperates with the entry pallet-stone and the other, of smaller radius, cooperates with the exit pallet-stone confers to the assembly escapement wheel-pallet an output higher than that including the same assembly comprising only one single escapement wheel, and that, even if the entry and exit pallet-stones are located substantially at the same distance from the line connecting the arbour of the escapement wheel set to the staff on which the pallet is articulated, as that is the case in a conventional Swiss lever escapement. It is specified here that the radiuses of the wheels are taken at their periphery and thus include the ends of the teeth. One will now explain the reasons of such an improvement in connection with FIGS. 3 and 4.

Figure 3:
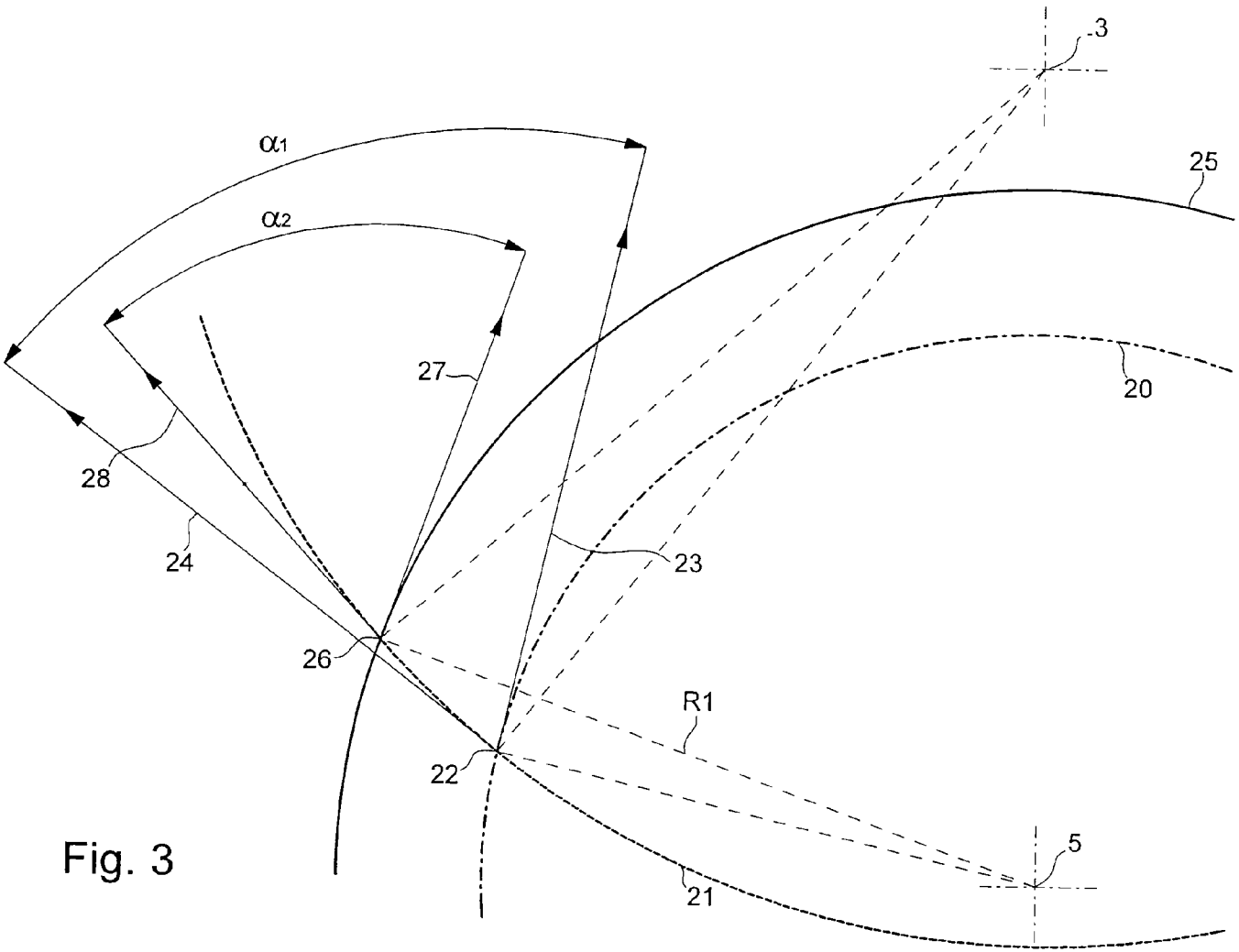
FIG. 3 is a diagram showing the angle formed by the instantaneous direction of the displacement of a tooth of the escapement wheel and by the instantaneous direction of the displacement of the entry pallet-stone of the pallet, that for two radiuses different from the escapement wheel.

FIG. 3 is a diagram of the angle $\alpha$ formed by the instantaneous direction of the displacement of a tooth of the escapement wheel and by the instantaneous direction of the displacement of the entry pallet-stone of the pallet, the tooth being represented in a position corresponding to the end of an impulse.

The trajectory 20 of the teeth of a single escapement wheel obeying the prior art is represented in chain dotted lines and the trajectory 21 of the entry pallet-stone of the pallet is represented in dotted lines. Numeral reference 5 designates the arbour of the wheel and Numeral reference 3 designates the staff of the pallet. At the point of impact 22 of the tooth with the pallet-stone, one finds the instantaneous direction 23 of the displacement of the tooth which is a tangent to trajectory 20 of the wheel. At the same point of impact 22, one finds the instantaneous direction 24 of the displacement of the entry pallet-stone which is a tangent to trajectory 21 of the pallet-stone. These directions 23 and 24 form an angle $\alpha 1$.

The trajectory 25 of the teeth of an escapement wheel of large radius R1 made according to the invention is represented in full line and the same trajectory 21 of the entry pallet-stone of the pallet is represented in dotted line. Numeral reference 5 still designates the arbour of the wheel and numeral reference 3 designates the staff of the pallet. At the point of impact 26 of the tooth with the pallet-stone one finds the instantaneous direction 27 of the displacement of the tooth which is a tangent to trajectory 25 of the wheel. At the same point of impact 26, one finds the instantaneous direction 28 of the displacement of the entry pallet-stone which is a tangent to trajectory 21 of the pallet-stone. Directions 27 and 28 form an angle $\alpha 2$.

It will be noted that the point of impact 26 is separated from arbour 5 of the wheel having the same radius R1 as the radius R1 of the wheel made according to the invention since, as mentioned above, the tooth of the wheel is represented in a position corresponding to the end of an impulse, at the time when the tip of this tooth leaves the pallet-stone.

By measuring in FIG. 3 the angles $\alpha 1$ and $\alpha 2$ one finds $\alpha 1=65°$ and $\alpha 2=62°$. By increasing the R1 radius of wheel 13 (see also FIG. 2), the angle $\alpha$ formed by the instantaneous direction of the displacement of a tooth of the escapement wheel and by the instantaneous direction of the displacement of the entry pallet-stone of the pallet is narrowed. However, one recalls here what has been mentioned in the preamble of this description, namely that the energy provided to the balance is increased if the pallet-stone describes a trajectory which makes, at the point of contact with the tooth of the escapement wheel, an angle as small as possible with the trajectory of said tooth. Consequently, decreasing the angle $\alpha$ causes the energy transmitted to the balance to increase and therefore, increases the output of the escapement.

The same reasoning can be held in connection with the exit pallet-stone of the pallet, this pallet-stone cooperating with a second escapement wheel having a radius R2 smaller than that of the first wheel.

Figure 4:
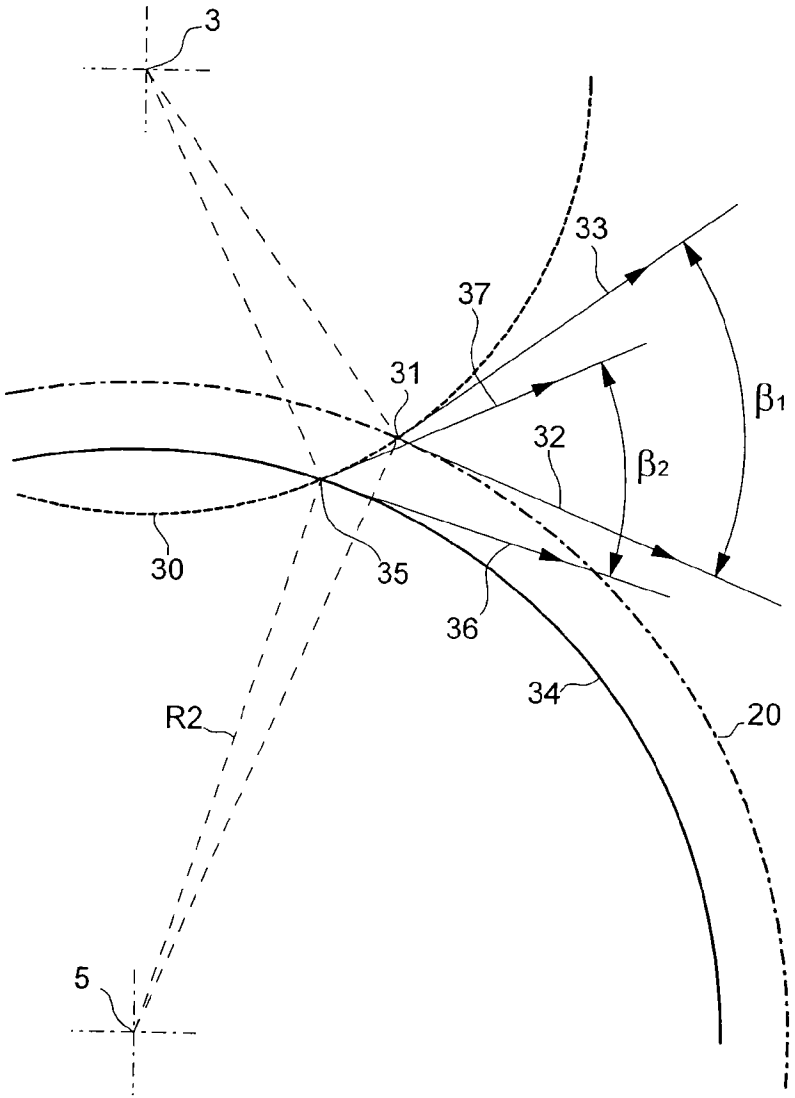
FIG. 4 is a diagram showing the angle formed by the instantaneous direction of the displacement of a tooth of the escapement wheel and by the instantaneous direction of the displacement of the exit pallet-stone of the pallet, that for two radiuses different from the escapement wheel.

FIG. 4 is a diagram of the angle $\beta$ formed by the instantaneous direction of the displacement of a tooth of the escapement wheel and by the instantaneous direction of the displacement of the exit pallet-stone of the pallet, the tooth being represented in a position corresponding to the end of an impulse.

The trajectory 20 of the teeth of a single escapement wheel obeying the prior art is represented in chain dotted line and the trajectory 30 of the exit pallet-stone of the pallet is represented in dotted lines. Numeral reference 5 still designates the arbour of the wheel and numerical reference 3 designates the staff of the pallet. At the point of impact 31 of the tooth with the pallet-stone, one finds the instantaneous direction 32 of the displacement of the tooth which is a tangent to the trajectory 20 of the wheel. At the same point of impact 31, one finds the instantaneous direction 33 of the displacement of the exit pallet-stone which is a tangent to the trajectory 30 of the pallet-stone. These directions 32 and 33 form an angle $\beta 1$.

The trajectory 34 of the teeth of an escapement wheel of small radius R2 made according to the invention is represented in dotted lines and the same trajectory 30 of the exit pallet-stone of the pallet is represented in dotted lines. Numeral reference 5 still designates the arbour of the wheel and numerical reference 3 designates the staff of the pallet. At the point of impact 35 of the tooth with the pallet-stone one finds the instantaneous direction 36 of displacement of the tooth which is a tangent to the trajectory 34 of the wheel. At the same point of impact 35, one finds the instantaneous direction 37 of the displacement of the exit pallet-stone which is a tangent to the trajectory 30 of the pallet-stone. Directions 36 and 37 form an angle β2.

It will be noted also here that the point of impact 35 is separated from arbour 5 of the wheel having the same radius R2 as the radius R2 of the wheel made according to the invention since, as mentioned above, the tooth of the wheel is represented in a position corresponding to the end of an impulse, at the time when the tip of this tooth leaves the pallet-stone.

By measuring in FIG. 4 the angles β1 and β2, one finds β1=59° and β2=42°. Thus by decreasing radius R2 of wheel 14 (see also FIG. 2), the angle β formed by the instantaneous direction of the displacement of a tooth of the escapement wheel and by the instantaneous direction of the displacement of the exit pallet-stone of the pallet is narrowed. However, one recalls again here what was mentioned in the preamble of this description, namely that the energy provided to the balance is increased if the pallet-stone describes a trajectory which makes, at the point of contact with the tooth of the escapement wheel, an angle as small as possible with the trajectory of said tooth. Thus decreasing the angle β causes the energy transmitted to the balance to increase and therefore, an increasing the output of the escapement.

It goes without saying that the improvement due to the entry pallet-stone is added to the improvement due to the exit pallet-stone and that the increase in output has to be understood in a global manner.

It will be noted that the first and second wheels 13 and 14 can be made in a single piece as modern technology allows it. This single piece will of course include a first level corresponding to the wheel of large radius and a second level corresponding to the wheel of smaller radius.

Finally, it will be noted that to double the escapement wheel as that is proposed in the present invention will double the moment of inertia of the assembly if the wheels are made by the conventional techniques (for example by stamping). To obviate this disadvantage, one can use modern manufacturing technologies. One of these technologies is called the galvanic growth micro-manufacturing and is described in the acts of the day of study 2003 of the "Société Suisse de chronométrie". This method enables a great freedom in the choice of the shape for the part to be manufactured. The escapement wheel can then be in the form of a radiant star, thereby avoiding the conventional felloe which carries the teeth. The moment of inertia of the wheel is therefore decreased. Another possible technology is the etching technology. In this case one can use silicon as the material to be etched which allows wheels of an extreme lightness to be made.

The invention claimed is:

1. An escapement for a timepiece, the escapement comprising:

(a) a pallet articulated on a staff and disposed to transmit energy to a balance; and (b) an escapement wheel set articulated on an arbour, wherein the pallet co-operates with the escapement wheel set and the escapement wheel set comprises a plurality of teeth uniformly spaced around the escapement wheel set, and the pallet includes an entry pallet-stone and an exit pallet-stone arranged to receive alternately an impulse from one of the teeth borne by the escapement wheel set and for acting as a locking plane for said one of the teeth, wherein the escapement wheel set comprises first and second integral and coaxial wheels, each of the first and second integral and coaxial wheels including the same number of teeth, wherein the entry pallet-stone and the exit pallet-stone each includes a locking face, wherein the entry and exit pallet-stones co-operate, respectively, via the locking faces with the first and second integral and coaxial wheels to transmit energy from the escapement wheel set to the balance, and wherein a peripheral radius of the first wheel is greater than a peripheral radius of the second wheel.

2. The escapement according to claim 1, wherein the first and second integral and coaxial wheels are made in a single piece.

3. The escapement according to claim 1, wherein the entry pallet-stone has a width larger than the width of the exit pallet-stone.

4. The escapement according to claim 1, wherein the first and second integral and coaxial wheels are made by galvanic growth.

5. The escapement according to claim 1, wherein the first and second integral and coaxial wheels are made by etching.

* * * * *